US009161641B2

(12) United States Patent
Wentland

(10) Patent No.: US 9,161,641 B2
(45) Date of Patent: Oct. 20, 2015

(54) FOLDABLE MAT

(71) Applicant: Matthew Aarron Wentland, Denver, CO (US)

(72) Inventor: Matthew Aarron Wentland, Denver, CO (US)

(73) Assignee: Wentland Works, Inc., Denver, CO (US)

( * ) Notice: Subject to any disclaimer, the term of this patent is extended or adjusted under 35 U.S.C. 154(b) by 167 days.

(21) Appl. No.: 14/063,535

(22) Filed: Oct. 25, 2013

(65) Prior Publication Data

US 2015/0113730 A1 Apr. 30, 2015

(51) Int. Cl.
*A47G 9/06* (2006.01)
*A45F 3/00* (2006.01)

(52) U.S. Cl.
CPC .. *A47G 9/062* (2013.01); *A45F 3/00* (2013.01)

(58) Field of Classification Search
CPC ..... A47G 9/06
USPC ..... 5/417–420, 722, 656, 657
See application file for complete search history.

(56) References Cited

U.S. PATENT DOCUMENTS

| | | | | |
|---|---|---|---|---|
| 4,682,447 | A * | 7/1987 | Osborn | 52/3 |
| 5,028,468 | A * | 7/1991 | Taylor | 428/71 |
| 2003/0232175 | A1* | 12/2003 | Zahler | 428/163 |
| 2011/0026857 | A1* | 2/2011 | Bautista | 383/12 |

* cited by examiner

*Primary Examiner* — Fredrick Conley
(74) *Attorney, Agent, or Firm* — Justin Lampel

(57) ABSTRACT

A foldable mat is provided. The foldable mat may move from a usable First Position A to a condensed Second Position B. The foldable mat has a plurality of grommets. The grommets are located along the four corners of the mat. The front and the back of the mat have a plurality of protrusions which extend outward and cover substantially the entire top and bottom surface of the mat. A first crease lacking the protrusions extends along the center of the mat parallel to the side of the foldable mat and a second crease lacking the protrusion extends along the center of the mat substantially perpendicular with respect to the first crease. The mat may be folded into a Second Position B and a fastener may secure the foldable mat in the Second Position B by securing the grommets together.

2 Claims, 8 Drawing Sheets

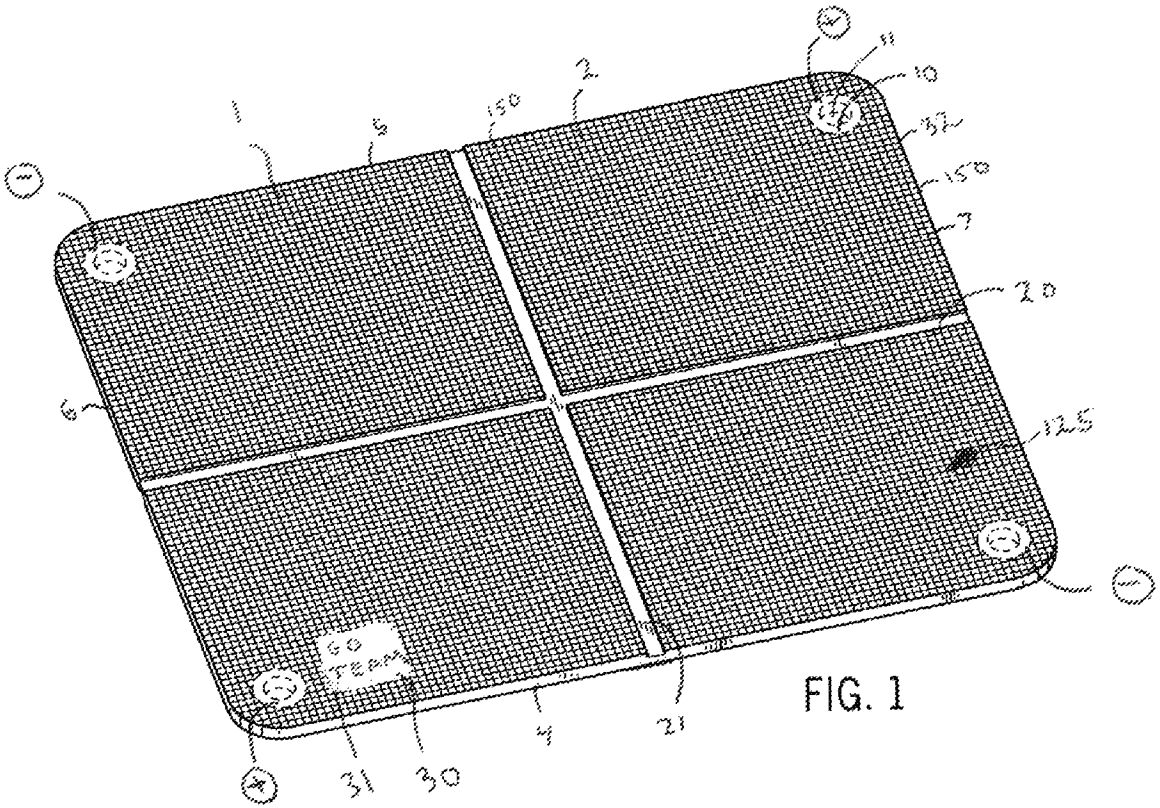
1
2
3
4
5
6
7
7a
7b
7c
8
9
10
11
12
13
14
15
15a
15b
16
17
18
19
20
21
22
23
24
25
26
27
28
29
30
31
32
33
34
35
36
37
38
39
40
41
42
43
44
45
46
47
48
49
50
51
52
53
54
55

FOLDABLE MAT

CROSS REFERENCE TO RELATED APPLICATION

The following application is based on and claims the priority benefit of U.S. Provisional Application Ser. No. 61/718,895 filed on Oct. 26, 2012; the entire contents of which are incorporated by reference.

BACKGROUND OF THE INVENTION

A foldable mat is provided. The mat is especially suitable for use by skiers, mountain bikers, campers, golfers and beach-goers. The foldable mat may move from a usable First Position A to a condensed Second Position B. The foldable mat has a plurality of grommets. In an embodiment, four grommets are located on the mat and provide an opening passageway between the top of the mat and the bottom of the mat. The four grommets are located along the four corners of the mat. The front and the back of the mat have a plurality of protrusions which extend outward and cover substantially the entire top and bottom surface of the mat. A first crease lacking the protrusions extends along the center of the mat parallel to the side of the foldable mat and a second crease lacking the protrusion extends along the center of the mat substantially perpendicular with respect to the first crease. The mat may be folded into a Second Position B and a fastener may secure the foldable mat in the Second Position B by securing the grommets together.

Foldable mats are well known. For example, U.S. Pat. No. 6,578,022 to Devine discloses a foldable, portable, magnetic tool mat. The tool mat includes generally rectangular obverse and reverse panels each formed of flexible material and connected together along substantially common side and end margins and along evenly spaced apart seam lines extending between said side margins defining elongated magnet bar holding portions. An elongated permanent magnet bar is held within each holding portion each without substantially inhibiting selective tool mat folding for fit and storage. The reverse panel is substantially thicker than the obverse panel for better wear characteristics and maximal magnetic attractive forces for tool and hardware retention. An attaching strap holds the tool mat.

Further, U.S. Pat. No. 7,188,713 to Espar discloses a mat/carrier foldable between a substantially flat configuration and a storage configuration. The mat/carrier comprises a mat/carrier component having a base panel, a plurality of side panels, and at least one intermediate panel intermediate adjacent side panels. A first set of folds separates each panel from its adjacent panels to facilitate re-orientation of each panel relative to its adjacent panels so as to form a container configuration. A second set of folds in at least some of the panels facilitate at least partial collapsing of the mat/carrier component from the container configuration to a smaller container configuration.

Still further, U.S. Pat. No. 6,752,773 to Leung discloses a foldable bubbling bath mat having two or more interconnected segments and a number of air channels with two or more apertures located in a bottom surface of the air channels. The bubbling bath mat is adapted to produce varying sized air bubbles and, thus, improve the overall therapeutic massaging effect on a user.

However, these patents fail to provide a foldable mat which is suitable for use on, for example, a snow mountain by winter sports enthusiasts. A need therefore exists for a foldable mat which has the features of the present foldable mat. Further, a need exists for a foldable mat which may be easily cleaned, folded and transported.

SUMMARY OF THE INVENTION

A foldable mat is provided. The mat is especially suitable for use by skiers, mountain bikers, campers, golfers and beach-goers. The foldable mat may move from a usable First Position A to a condensed Second Position B. The foldable mat has a plurality of grommets. In an embodiment, four grommets are located on the mat and provide an opening passageway between the top of the mat and the bottom of the mat. The four grommets are located along the four corners of the mat. The front and the back of the mat have a plurality of protrusions which extend outward and cover substantially the entire top and bottom surface of the mat. A first crease lacking the protrusions extends along the center of the mat parallel to the side of the foldable mat and a second crease lacking the protrusion extends along the center of the mat substantially perpendicular with respect to the first crease. The mat may be folded into a Second Position B and a fastener may secure the foldable mat in the Second Position B by securing the grommets together.

An advantage of the present foldable mat is to provide a foldable mat which may be easily cleaned.

Still another advantage of the present foldable mat is that the present mat allows a user to keep his/her equipment and property clean while utilizing the equipment in a dirty natural environment.

And another advantage of the present foldable mat is that the present mat allows a user to avoid having to hop on one leg while changing in a dirty environment.

Yet another advantage of the present foldable mat is to provide foldable mat which has a plurality of protrusions which prevents the bottom of the mat from slipping and further prevents a user from slipping off the top of the mat.

Still another advantage of the present foldable mat is to provide a foldable mat which may be easily folded and secured in a folded position.

And another advantage of the present foldable mat is to provide a foldable mat having a plurality of grommets which allow for the mat to be easily folded and secured in the folded position.

Yet another advantage of the present mat is that the present mat may have an area for displaying indicia, such as, a sports logo, a school logo, or instructional information with respect to use of the mat.

Still another advantage of the present mat is that the present mat may be easily transported.

Another advantage of the present foldable mat is that the foldable mat may be secured in the Second Position B and any mud or water located on the bottom surface of the mat will become trapped on the inside of the folded mat as a result of the mat folding in a fashion so that only the bottom (dirty) side of the mat touches itself.

Yet another advantage of the present foldable mat is that the foldable mat may have an antibacterial agent secured to the top and or bottom surface of the mat to prevent the spreading of harmful bacteria.

Still another advantage of the present foldable mat is that the foldable mat may be water resistant.

Yet another advantage of the present foldable mat is that the foldable mat may have a slightly adhesive sticky surface so as to prevent a person or item from slipping off the top of the mat.

And another advantage of the foldable mat is that the foldable mat may have an impermeable waterproof layer imbedded within the mat made from, for example, Gore-tex.

Still another advantage of the foldable mat is that the foldable mat may have a reinforced hard layer (i.e. Kevlar) for added durability.

Another advantage of the present foldable mat is that the foldable mat may be rolled up.

Another advantage of the present foldable mat is that the foldable mat may have outside edge coated with an impermeable substance, or heat sealed to increase water resistance and durability.

Yet another advantage of the present foldable mat is that the present foldable mat may have grommets which are magnetic and which attract each other which allows the mat to be folded together and secured together by the grommets even without a securing mechanism.

Still another advantage of the present foldable mat is that the present mat may be folded once to provide a greater surface area for standing or sitting.

And another advantage of the present foldable mat is that the present mat may be used as a seat in stadiums.

And another advantage of the present mat is that the present mat may have an internal metal wire which is electrically and mechanically connected to a heat source wherein the metal wire heats up and provides increased comfort for the user as well as helps melt snow or ice which may accumulate on the top or bottom of the mat.

For a more complete understanding of the above listed features and advantages of the foldable mat reference should be made to the following detailed description of the preferred embodiments and to the accompanying drawings. Further, additional features and advantages of the present foldable mat are described in, and will be apparent from, the detailed description of the preferred embodiments and from the drawings.

BRIEF DESCRIPTION OF THE DRAWINGS

FIG. 1 illustrates a perspective view of the folded mat in the First Position A.

DETAILED DESCRIPTION OF THE PREFERRED EMBODIMENTS

A foldable mat is provided. The foldable mat may move from a usable First Position A to a condensed Second Position B. The mat is especially suitable for use by skiers, mountain bikers, campers, golfers and beach-goers. The foldable mat has a plurality of grommets. In an embodiment, four grommets are located on the mat and provide an opening passageway between the top of the mat and the bottom of the mat. The four grommets are located along the four corners of the mat. The front and the back of the mat have a plurality of protrusions which extend outward and cover substantially the entire top and bottom surface of the mat. A first crease lacking the protrusions extends along the center of the mat parallel to the side of the foldable mat and a second crease lacking the protrusion extends along the center of the mat substantially perpendicular with respect to the first crease. The mat may be folded into a Second Position B and a fastener may secure the foldable mat in the Second Position B by securing the grommets together.

Figure 3:
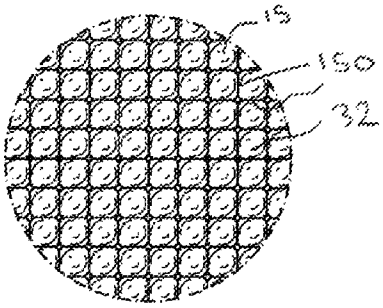
FIG. 3 illustrates a detailed view of the top and bottom surface of the mat.
Figure 4:
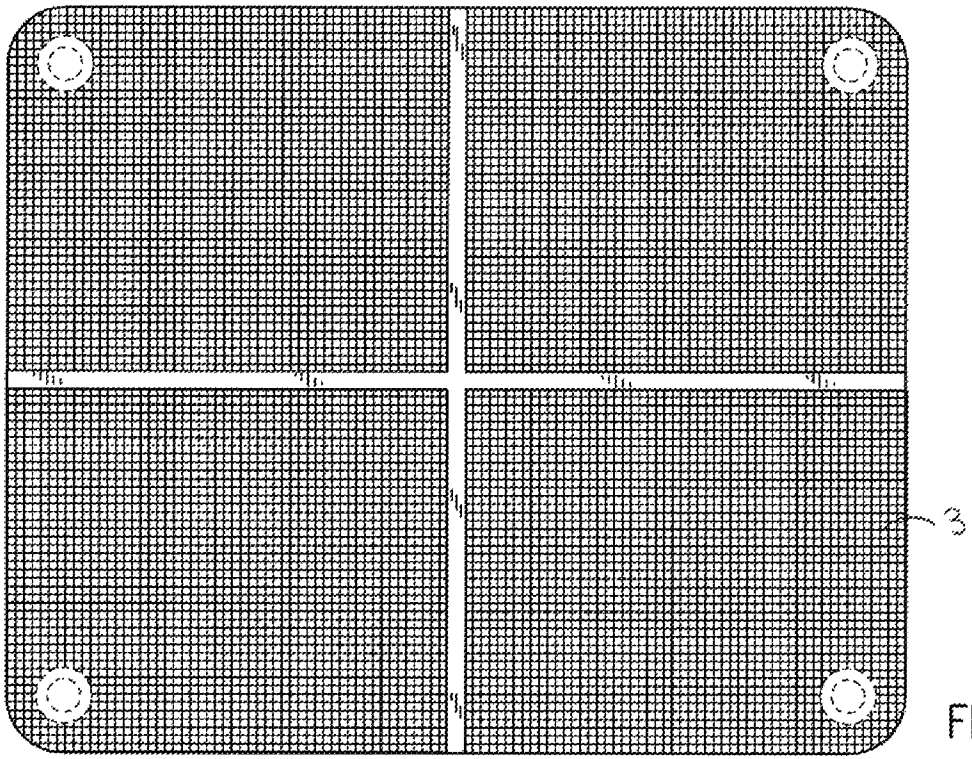
FIG. 4 illustrates a plan view of the bottom of the foldable mat in an embodiment.

Referring now to FIG. 1, a foldable mat 1 is provided. The foldable mat 1 may have a top 2, a bottom 3 (FIGS. 4 and 8), a front 4, a back 5, a first side 6 and a second side 7. The foldable mat 1 is illustrated as generally rectangular; however, any shape mat 1 may be used. Preferably, the mat 1 is made predominately of rubber, foam and/or plastic. The top 2 and the bottom 3 of the foldable mat 1 may have a plurality of protrusions 15 (FIG. 3). The plurality of protrusions 15 may provide additional surface area which may reduce the chances of a user slipping from the top 2 of the foldable mat 1 and may further prevent slippage of the bottom 3 of the foldable matt 1 with respect to the ground (which may be snow or ice). In an embodiment, each of the plurality of protrusions 15 may move independently of one another so as to better grip a surface (including the ground).

In an embodiment, the plurality of protrusions 15 may, for example, resemble a grid and may be constructed of largely independent square-shaped elements 32 having a plurality of generally perpendicular creases 150 (a minor crease) located between the independent square-shaped elements 32. In an embodiment, the independent square-shaped elements 32 substantially cover the entire top 2 and entire bottom 3 of the device 1 aside from the grommet 10 and creases 20, 21 (as defined below).

Figure 5:
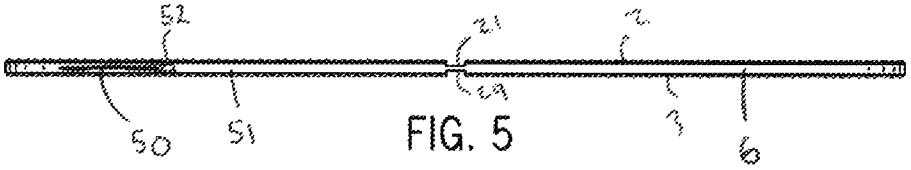
FIG. 5 illustrates a side view of the front foldable mat in an embodiment having main creases on the top and bottom of the mat.
Figure 6:
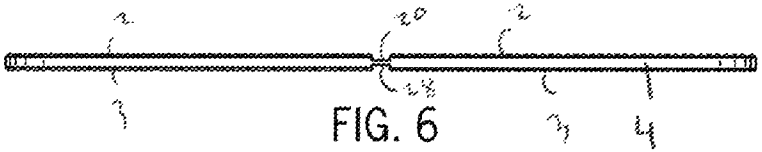
FIG. 6 illustrates a side view of the first or second side of the foldable mat in an embodiment having main creases on the top and bottom of the mat.

Referring now to FIG. 5, in an embodiment, the plurality of protrusions 15 may have a height. The height of the plurality of protrusions 15 may extend above the top 2 of the device 1. The height of the plurality of protrusions 15 may be less than the thickness of the mat 1 as is illustrated in FIGS. 5 and 6.

The creases 150 between the independent square-shaped elements 32 may allow the surface of the device 1 to easily be bent into various orientations so as to better provide a stable surface with the ground when the device 1 is stood upon by a person.

Figure 2:
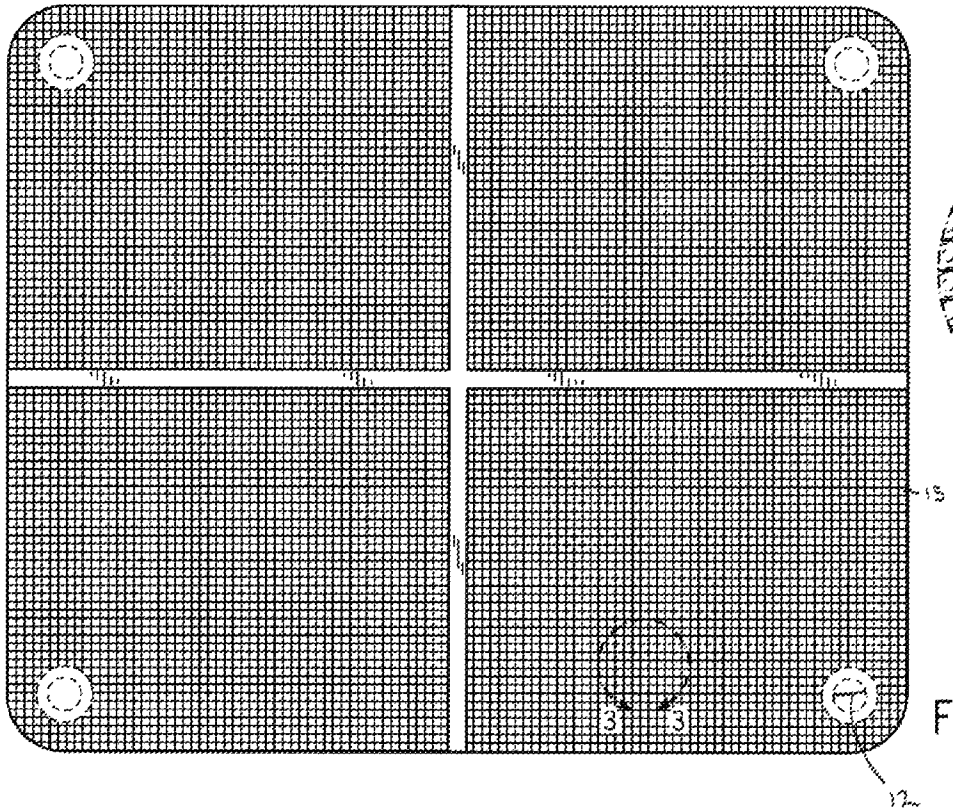
FIG. 2 illustrates a top plan view of the folded mat.

The foldable mat 1 may have a plurality of corners; generally four. In an embodiment, the corners of the mat 1 may be curved so as to prevent the corners of the mat 1 from causing damage to property or injury to a person which may occur if the corners have sharp points. Located near each of the plurality of corners may be a grommet 10. The grommets 10 may be generally circular (having an arch similar to that of the curvature of the corners). The grommet 10 may be made from, for example, metal and may have an opening 11 having a diameter 12 (FIG. 2). The grommets 10 may provide an opening passageway between the top 2 of the foldable mat 1 and the bottom 3 of the foldable mat 1.

In an embodiment, the grommets 10 may be magnetic such that the grommets 10 are attracted to each other and may secure the device 1 in the folded Second Position B when the grommets 10 are brought together by folding the device 1 twice. More specifically, the grommets 10 may have a polarity such that when folded, the corners of the device 1 are attracted to each other.

In particular, the grommet 10 at, for example, the front 4 first side 6 and the back 5 second side 7 may have, for example, a positive polarity on the top 2 of the device 1 and a negative polarity on the bottom 3 of the device 1 while the grommet 10 on the back 5 first side 6 and the grommet 10 on the front 4 second side 7 may have a negative polarity on the top 2 of the device 1. More specifically, kitty-corner grommets 10 have the same polarity orientation with respect to the top 2 and the bottom 3 of the device 1.

When the device 1 is first folded in half (going from the First Position A to the Second Position B) along either the first crease 20 or the second crease 21, the grommets 10 which come into contact with each other will have opposite polarities and will be attracted to each other. Next, the device 1 is again folded in half so that the device 1 ends up one-quarter the size. Upon the second folding, the grommets 10 again will have opposite polarities and therein attract each other when the grommets 10 come into contact with each other when folded the second time.

Located on the top 2 and the bottom 3 of the mat 1 may be, for example, two generally straight smooth creases. More specifically, the foldable mat 1 may have a first smooth crease 20 (a main crease) and a second smooth crease 21 (a main crease). The first smooth crease 20 may be located substantially parallel with respect to the front 4 and the back 5 of the foldable mat 1 whereas the second smooth crease 21 may be located substantially parallel with respect to the first side 6 and the second side 7 of the foldable mat 1. As a result, the first smooth crease 20 and the second smooth crease 21 may be largely perpendicular with respect to each another. The creases 20, 21 may be smooth as a result of the lack the protrusions 15 along the creases 20, 21.

In an embodiment, the first smooth crease 20 may be located approximately half way between the front 4 and the back 5 of the mat 1. In an embodiment, the second crease 21 may be located approximately half-way between the first side 6 and the second side 7 of the mat 1. As illustrated in FIGS. 5 and 6, in an embodiment, the first smooth crease 20 on the top 2 of the device 1 may be located directly above another smooth crease 28 of the bottom 3 of the device 1 and the second smooth crease 21 of the top 2 of the device 1 may be located directly above another second smooth crease 29 of the bottom 3 of the device 1.

In an embodiment, the first crease 20 may extend the entire length of the device 1 reaching from the first side 6 of the mat 1 to the second side 7 of the mat 1. In an embodiment, the second crease 21 may extend the entire width of the device 1 reaching from the front 4 of the mat 1 to the back 5 of the mat 1. The first smooth crease 20 and the second smooth crease 21 may lack the protrusions 15. More specifically, the lack of protrusions 15 on the first smooth crease 20 and the second smooth crease 21 may allow the foldable mat 1 to more easily fold.

In an embodiment, the top 2 of the foldable mat 1 may have an area 30 wherein indicia 31 is displayed. The indicia 31 may be, for example, a logo of a sports team, a university, an ornamental design, a series of instructions regarding use and/or maintenance of the mat 1 or otherwise.

In an embodiment, a metal wire 50 (FIG. 5) may be located within an interior 51 of the foldable mat 1. The metal wire 50 may be electrically and mechanically connected to a power source 52 which may, in turn, be plugged into a standard outlet, a car outlet, a battery or some other power source. The metal wire 50 may heat up providing both warmth for the user and may further help melt snow or ice which may accumulate on the top 2 or the bottom 3 of the foldable mat 1.

Figure 7:
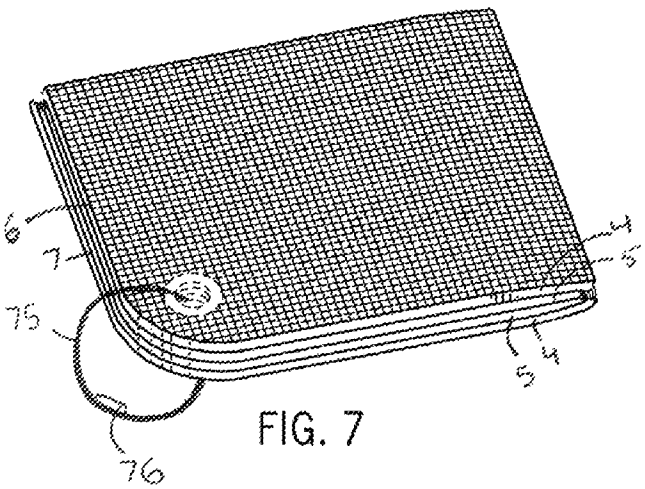
FIG. 7 illustrates the foldable mat in the folded Second Position B.

To move the foldable mat 1 from the First Position A (the usable position—FIG. 1) to the Second Position B (FIG. 7), the user first folds the foldable mat 1 in half, along an x-axis or y-axis. More specifically, the user may fold the foldable mat 1 along the first crease 20 of the top 2 of the foldable mat 1. In an embodiment, the user may simply utilize the mat 1 while the mat 1 is only folded once (FIG. 9C). This will result in a greater surface area to sit or stand. If two folds are desired, once the first fold is completed, a user may then fold the foldable mat 1 a second time along the second crease 21 of the foldable mat 1 so that the foldable mat 1 occupies approximately one-fourth the surface area. When the foldable mat 1 is folded twice along the first crease 20 and second crease 21, the four grommets 10 may align. When the four grommets 10 align, a user may place a securing mechanism 75 through all four grommets 10. The securing mechanism 75 may act similar to a mini-clip key chain wherein the user may easily secure the grommets 10 together or may easily separate the grommets 10. The securing mechanism 75 may have a movable lock 76 which allows the securing mechanism 75 to be temporarily secured through the grommets 10. In the Second Position B (FIG. 7), the foldable mat 1 is more easily transported and stored while in the First Position A the foldable mat 1 provides greater surface area for a user to stand on the foldable mat 1 and protect, for example, the feet of the user, especially in snow or ice conditions.

When the foldable mat 1 is folded into the Second Position B (the closed position) any mud, water or dirt located on the bottom 3 of the foldable mat 1 may be folded such that the bottom 3 of the foldable mat 1 only contacts itself. More specifically, the top 2 of the foldable mat 1 may remain clean whereas any mud, water, dirt located on the bottom 3 of the foldable mat 1 will remain trapped on the inside of the folded mat 1. The foldable mat 1 may then be easily and transported in a clean manner.

In an embodiment, the top 2, bottom 3 and sides of the foldable mat 1 may be coated with an antibacterial agent 125 which may reduce the spread of germs. The antibacterial agent 125 may further reduce the growth of mold should the folded mat 1 not be cleaned for a prolonged period of time.

Figure 8:
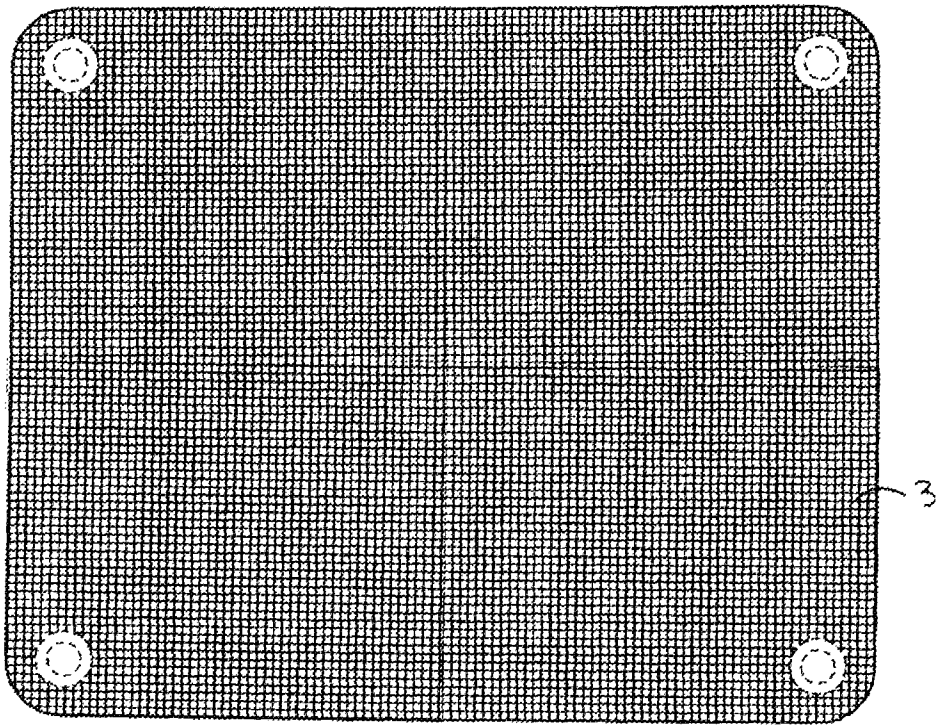
FIG. 8 illustrates an alternative embodiment wherein the bottom of the mat lacks the first and second crease.
Figure 10:
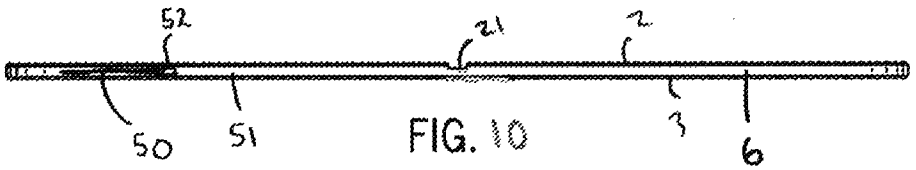
FIG. 10 illustrates a side view of the front of the foldable mat in an embodiment wherein only the top of the mat has main creases.
Figure 11:
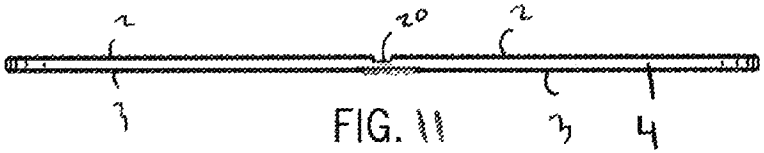
FIG. 11 illustrates a side view of the first or second side of the mat in an embodiment wherein only the top of the mat has main creases.

Referring now to FIGS. 8, 10 and 11, in an embodiment, the bottom 3 of the mat 1 does not have a first crease 20 and does not have a second crease 21 while the top 2 of the mat 1 does have the first crease 20 and the second crease 21. In this embodiment, the mat 1 is easily folded inward at the creases 20, 21 on the top 2 of the mat 1, toward the bottom 3 of the mat 1 and resists folding upward toward the top 2 of the mat 1 as a result of the bottom 3 lacking the creases 20, 21. Because the bottom 3 of the mat 1 is the surface which contacts the ground and is typically dirty, when the user folds the mat 1 first in half toward the bottom 3, the dirt on the bottom 3 becomes trapped between the two halves of the bottom 3 of the mat 1 while the top 2 surface of the mat 1 (the clean side) is the only portion of the mat 1 which is visible. A user then further folds the mat 1 so that a portion of the top 2 of the mat 1 folds onto another portion of the top 2 of the mat 1 (resulting in the mat 1 now being one quarter the size). As a result, any dirt 99 which was located on the bottom 3 of the mat 1 is now securely trapped within the interior of the folded mat 1 and the mat 1 may be carried or otherwise transported without the dirt 99 escaping and causing a mess.

Figure 9:
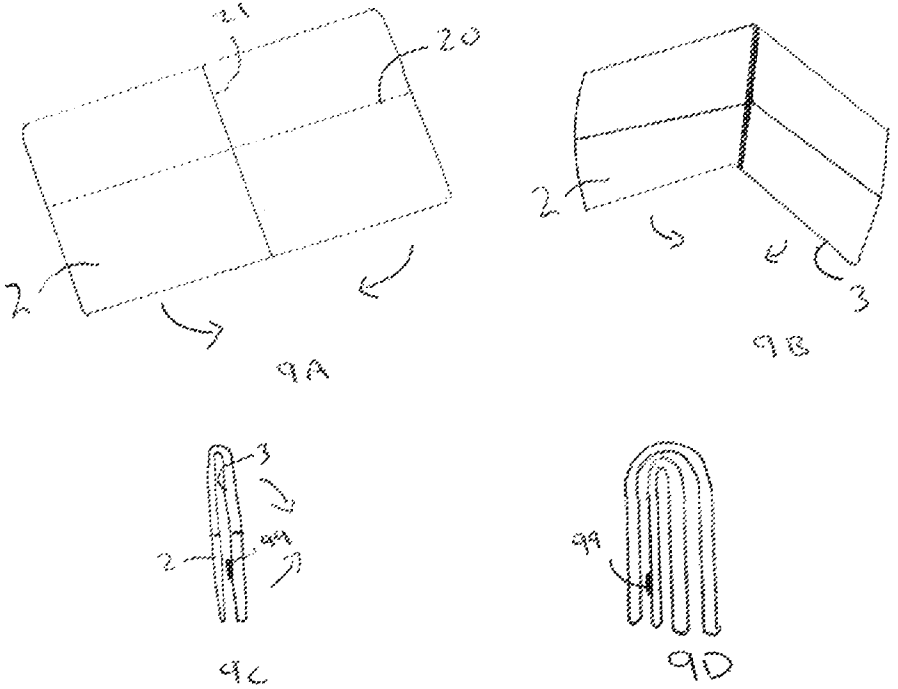
FIGS. 9A-9D illustrate the mat being folded.

Referring now to FIG. 9, the mat 1 is illustrated being folded. FIG. 9A illustrates the mat 1 in the First Position A (generally flat). FIG. 9B illustrates the mat 1 being folded into half at the first crease 20 wherein the bottom 3 of the mat 1 ends up sandwiched between the top 2 layers. FIG. 9C illustrates the bottom 3 being secured between the top 2 layers such that dirt 99 or other debris located on the bottom 3 of the mat 1 becomes secured within the interior portion of the mat 1. FIG. 9D illustrates the mat 1 folded again (this time at the second crease 21) resulting in the mat 1 having approximately one quarter the surface area.

Although embodiments of the present invention are shown and described therein, it should be understood that various changes and modifications to the presently preferred embodiments will be apparent to those skilled in the art. Such changes and modifications may be made without departing from the spirit and scope of the present invention and without diminishing its attendant advantages. It is, therefore, intended that such changes and modifications be covered by the appended claims.

The invention claimed is:

1. A method of trapping dirt in a foldable mat comprising the steps of:

providing a foldable mat having: a base platform having a top, a bottom, a front, a back, a first side, a second side and having a top surface area located between the front, the back, the first side and the second side; a first corner, second corner, third corner and forth corner of the base platform; a first crease located half-way between the front and the back of the base platform wherein the first crease is parallel to the front and the back; a second crease located half-way between the first side and the second side of the bas platform wherein the second crease is parallel to the first side and second side; wherein the first crease and the second crease intersect at a ninety degree angle and wherein the first crease and the second crease allow the base platform to be folded twice resulting in a second top surface area approximately one-quarter the top surface area; and a plurality of protrusions located on the top and the bottom of the base platform wherein the plurality of protrusions prevents slippage of the base platform with respect to a ground surface;

placing the foldable mat on the ground wherein the ground has dirt which attaches to the bottom of the base platform of the foldable mat; and folding the base platform in half at the first crease so that the dirt from the ground is secured between two layers of the foldable mat and wherein the top surface of the foldable mat remains on the folded outside and wherein the dirt is trapped on the inside of the folded mat and wherein the dirt touches only the bottom of the foldable mat.

2. A method of trapping dirt in a foldable mat comprising the steps of:

providing a foldable mat having: a base platform having a top, a bottom, a front, a back, a first side, a second side and having a top surface area located between the front, the back, the first side and the second side; a first corner, second corner, third corner and forth corner of the base platform; a first crease located half-way between the front and the back of the base platform wherein the first crease is parallel to the front and the back; a second crease located half-way between the first side and the second side of the bas platform wherein the second crease is parallel to the first side and second side; wherein the first crease and the second crease intersect at a ninety degree angle and wherein the first crease and the second crease allow the base platform to be folded twice resulting in a second top surface area approximately one-quarter the top surface area; and a plurality of protrusions located on the top and the bottom of the base platform wherein the plurality of protrusions prevents slippage of the base platform with respect to a ground surface;

placing the foldable mat on the ground wherein the ground has dirt which attaches to the bottom of the base platform of the foldable mat;

folding the base platform in half at the first crease so that the dirt from the ground is secured between two layers of the foldable mat and wherein the top surface of the foldable mat remains on the folded outside and wherein the dirt is trapped on the inside of the folded mat and wherein the dirt touches only the bottom of the foldable mat; and folding the foldable mat a second time at the second crease.

* * * * *